United States Patent [19]

Burge

[11] Patent Number: 4,658,905

[45] Date of Patent: Apr. 21, 1987

[54] MUD VALVE

[76] Inventor: Edward V. Burge, 2620 Durgan, Houston, Tex. 77043

[21] Appl. No.: 747,296

[22] Filed: Jun. 21, 1985

[51] Int. Cl.[4] ..... E21B 34/08

[52] U.S. Cl. ..... 166/373; 166/325

[58] Field of Search ..... 166/373, 383, 386, 317, 166/319–322, 325, 153, 154; 137/71, 515, 515.5, 493.3, 493.9, 508; 175/218

[56] References Cited

U.S. PATENT DOCUMENTS

| | | | |
|---|---|---|---|
| 3,967,679 | 7/1976 | Liljestrand | 166/325 X |
| 4,128,108 | 12/1978 | Parker et al. | 137/508 X |
| 4,364,407 | 12/1982 | Hilliard | 166/325 X |

*Primary Examiner*—Stephen J. Novosad
*Assistant Examiner*—Thuy M. Bui
*Attorney, Agent, or Firm*—Stanley R. Moore; Thomas L. Cantrell

[57] ABSTRACT

A mud saver valve comprising a tubular body connectable between a kelly and a drill string. A piston is mounted therein and includes a bore substantially coaxially aligned with the central opening. A plug is removably mounted in the piston and is movable between a first position wherein a spear sealingly engages the valve seat and a second position that allows fluid to flow upward between the spear and the valve seat. The piston is constructed with an elongate intermediate body section having a plurality of O-rings secured therein and disposed beneath angled ports for enhancing lateral stability of the piston within the body. The valve seat is furthermore secured within the body by a spanner ring with the valve seat being formed with a curved mating surface adapted for flushly engaging a curved valve seat surface of a valve seat disposed upon the piston. Both the upper and lower valve seats are removable for field repair while axially actuatable with lateral stability.

22 Claims, 5 Drawing Figures

MUD VALVE

BACKGROUND OF THE INVENTION

1. Field of the Invention

The present invention relates to valves, and more particularly, to bore hole drill string valves for preventing the loss of drilling mud through the drill pipe during the drilling operation.

2. History of the Prior Art

In drilling oil and gas wells or the like by the rotary drilling method, the drill bit is rotated by a string of drill pipe connected to a kelly suspended in a derrick at the earth's surface. Drilling mud, or chemically laden drilling fluid, is pumped through the kelly and string of drill pipe to the drilling bit in a manner well known in the art. During the actual drilling operation, it is repeatedly necessary to disconnect the kelly from the drill string each time additional strands of drill pipe are added to the string. Since the kelly is generally filled with drilling mud or fluid, it is desirable to insert between the kelly and the drill string a valve that will allow mud to flow through the kelly and drill string during drilling, but will automatically close when the mud pumps are deactuated and the kelly is disconnected from the drill string.

The prior art is replete with valve designs for such purposes. These valves are commonly referred to as "mud saver valves" in that the drilling mud is contained rather than lost during this operation. Once disconnected, it is possible to empty the entire contents of drilling fluid in the kelly onto the drilling derrick floor. In drilling a well, it is not unusual for 100–150 barrels of drilling fluid to be lost in this manner. Such an event will result in not only a waste of large quantities of expensive drilling fluid but also the discharge of mud over the adjacent area and workmen to make the derrick floor dangerously wet and slippery. This produces a hazardous situation for personnel working on the derrick floor as well as costing time for maintenance.

Numerous prior art patents have addressed mud saver valve designs. Such valve designs generally incorporate a valve seat, a closure member and means for urging the closure member into engagement with the valve seat. For example U.S. Pat. No. 4,364,407 assigned to the inventor of the present invention discloses a valve having a tubular body connectable between the kelly and the drill string. An annular seat ring having a central opening is mounted within the body. A piston is axially movably disposed with the body for engagement within the seat ring. The piston includes a bore substantially coaxially aligned with the central opening of the seat ring and a flange extending radially outwardly from the piston to slidingly engage the interior of the body. The piston of the aforesaid patent includes a plurality of ports above the piston communicating the exterior of the piston with the bore. A plug is removably mounted in the piston above the ports to normally close the bore. The plug includes a sheer ring removably inserted in the bore and a spear axially movably mounted within the sheer ring and movable between a first position wherein the spear sealingly engages the sheer ring and a second position wherein fluid may flow upwardly between the spear and the sheer ring. A spring is provided to urge the piston into engagement with the seat ring. Other patents showing mud saver valve designs are set forth and shown in the Parker et al., U.S. Pat. No. 4,128,108; Liljestrend, U.S. Pat. No. 3,967,679; Williamson, U.S. Pat. No. 3,965,960; Litchfield et al., U.S. Pat. No. 3,738,436; Garrett, U.S. Pat. No. 3,698,411; and Taylor, U.S. Pat. No. 3,331,385.

The aforesaid patents disclose many advantages and improvements in mud saver valve designs. However, certain disadvantages exist with the prior art designs due to the very nature of the downhole environment. It is well known in the industry that the temperature, pressure and flow conditions of the borehole limit the life expectancy of drilling elements. The same holds true for mud saver valves in that the drilling mud flowing therethrough generally contains abrasive materials under pressure. Such flow can quickly disintegrate sealing surfaces. For this reason, the configuration of the sealing surface as well as the material from which the surfaces are made are integral elements of a reliable system. Moreover, axial and lateral stability of the valve itself is a key element of effective valve operation. Any misalignment in the valve seating can preclude adequate sealing which permits mud flow therefrom. Any flow of the abrasive mud will cause some deterioration in the misaligned area of the valve seat. Likewise, misalignment of mechanical parts in such high torque, high force assemblies can produce unnecessary and damaging wear upon the parts reducing their life span and requiring premature maintenance.

It would be an advantage, therefore, to overcome the disadvantages of the prior art by providing a mud flow valve having sufficient axially and lateral stability to permit effective valve seating and limited abrasive wear therethrough during high pressure mud flow conditions. The mud valve of the present invention provides such an assembly through the utilization of an elongate valve piston incorporating an exfundibular head axially aligned with an infundibular valve seat permitting the mud flow therethrough. The elongate construction reduces the potential eccentricities in valve seat alignment and the arcuate infundibular valve seating configuration facilitates the flow of abrasive mud therethrough without the deteriorating affects conventional in many prior art embodiments. Moreover, the valve seats can be constructed of suitably hard materials to withstand the aforesaid abrasive mud flow without substantial deterioration. Such an embodiment facilitates higher efficiency in operations and reduces requisite maintenance time and cost.

SUMMARY OF THE INVENTION

The present invention pertains to a mud valve for a borehole drill string adapted for enhanced operational reliability. More particularly, the present invention comprises an improved mud saver valve of the type including a tubular body connectable between a kelly and a drill string and a piston axially movable within the tubular body to form a valve seat therein. The valve incorporates a plug movably mounted within the piston to normally close the bore within the piston. The piston is normally biased into engagement with the valve seat for the closure thereof. The improvement comprises the tubular body being formed of upper and lower tubular sections adapted for mating engagement one to the other. An upper valve seat is formed in a lower region of the upper tubular body section and constructed with a curved, outwardly flared, or valve seating recess depending from a cylindrical bore forming an infundibular orifice therethrough. The piston is formed with an upper valve seat member having seat member adapted for matingly engaging the upper body valve seat member and formed with a generally cylindrical curved edge portion atop a cylindrical body portion comprising a generally exfundibular configuration adapted for matingly engaging the infundibular valve seat of the upper body. The piston is formed with a generally cylindrical elongate flange region adapted for axial alignment with and slidable engagement through the lower tubular member for facilitating the axial alignment lateral stability of the upper and lower valve seats.

In another embodiment, the above described mud saver valve further includes the piston having a hollow bore centrally formed therethrough and a valve seat sleeve adapted for receipt therein and securement atop the piston. The valve seat sleeve is formed with an outer curved edge portion adapted for matingly engaging the upper valve seat recess. The piston valve sleeve is further formed with a generally centrally disposed flange member extending outwardly therearound in a downwardly tapering configuration for abuttingly engaging an upper end of the piston and forming a smooth flow surface thereover for mud flowing between the mating valve seats. The piston valve sleeve may further comprise a generally cylindrical member adapted for receiving the plug therein and the axial reciprocation of the plug relative thereto. The piston is also constructed with a plurality of ports formed adjacent the flange in angle relationship relative thereto for facilitating the smooth flow of mud therein and through the bore of the piston.

In yet another aspect, the invention includes a well bore mud saver valve of the type positionable between a kelly and a drill string disposed within a borehole adapted for the flow of drilling mud therethrough. The valve comprises a housing adapted for securement between the kelly and drill string and being formed with an axial bore therethrough. An upper valve seat is formed within the housing bore and constructed with a generally cylindrical, curved valve seating recess therearound. A piston is disposed within the housing bore beneath the upper valve seat and is formed with a lower valve seat in an upper end thereof adapted for matingly engaging the upper valve seat and formed with a generally cylindrical, curved edge portion adapted for matingly engaging the curved recess of the upper valve seat. The piston being axially movable within the housing and is upwardly biased into engagement with the upper valve seat for the closure thereof. The piston is formed of a generally cylindrical, elongate intermediate body portion comprising a flange region adapted for receipt in, axial alignment with, and slidable engagement through the bore of the housing for facilitating the axial alignment and lateral stability of the upper and lower valve seats.

In a further aspect, the above valve includes a plug removably mounted in the piston to normally close the bore with the piston in the upwardly biased position of engagement with the upper valve seat. The piston further comprises a hollow bore centrally formed therethrough and wherein the lower valve seat comprises a valve seat sleeve adapted for receipt within the bore and securement atop the piston, the valve seat sleeve being formed with an outer curved edge portion adapted for matingly engaging the upper valve seat recess. The valve sleeve further comprises a generally centrally disposed flange member extending outwardly therearound in a downwardly tapering configuration adapted for abuttingly engaging an upper end of the piston and forming a smooth the valve seats. The piston valve sleeve comprises a generally cylindrical member adapted for receiving the plug therein and the axial reciprocation of the plug relative thereto. The piston is further constructed with a plurality of ports formed adjacent the flange in an angled relationship relative thereto for facilitating the smooth flow of mud therein and through the bore of the piston. The means biasing the piston upwardly against the upper valve seat comprises a spring axially disposed within the bore disposed around a lower region of the piston and in abutting engagement with the piston for urging the piston upwardly relative to the upper valve seat.

In yet another aspect, the above defined valve includes the housing constructed in a generally cylindrical configuration comprising a tubular body formed with a hollow bore therethrough. The tubular housing is comprised of upper and lower body sections, the upper and lower body sections being adapted for threadable engagement one with the other. The upper valve seat is disposed in the lower end of the upper tubular body portion and comprises a generally cylindrical member secured therein. The generally cylindrical upper valve seat member disposed within the lower end of the upper tubular member is also constructed with an inner lip having a generally infundibular orifice therethrough and an outer lip adapted for engagement with securing means for securing the cylindrical member within the upper tubular housing member. The piston is comprised of a generally hollow tubular member formed with an upper and lower necked regions and an intermediate body portion adapted for slidable engagement within the bore of the lower tubular housing member.

In but another aspect, the invention includes a method of mud saving in a well bore by the utilization of a valve positionable within a drill string disposed within a borehole between a kelly and a drill bit adapted for the flow of drilling mud therethrough. The method comprises the steps of providing a housing having an axial bore formed therethrough and securing the housing between the kelly and the drill string. An upper valve seat is then formed within the housing bore with a curved, infundibular valve seating recess therearound. A piston formed with a lower valve seat in an upper end thereof member is provided and adapted for matingly engaging the upper valve seat and formed with a generally cylindrical exfundibular edge portion adapted for matingly engaging the curved, infundibular recess of the upper valve seat. The piston is then formed with a generally cylindrical, elongate intermediate body portion comprising a flange region adapted for receipt in, axial alignment with, and slidable engagement through the bore of the housing for facilitating the axial alignment and lateral stability of the upper and lower valve seats. The piston is then disposed for axial movement within the housing, the piston is biased into engagement with the upper valve seat for the closure of the valve.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1A:
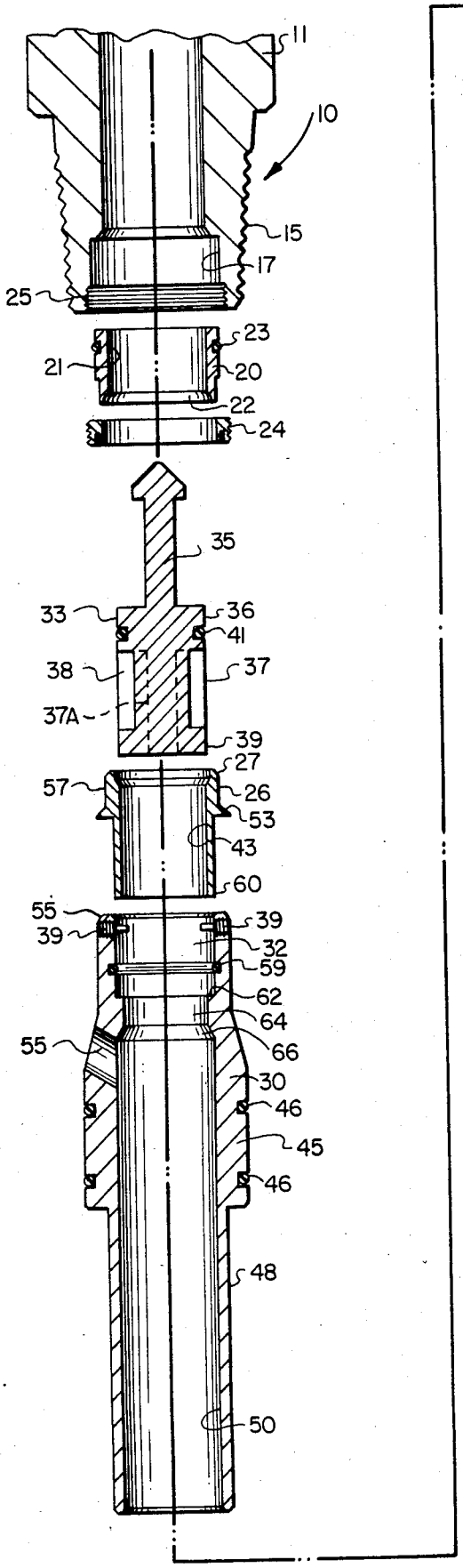
FIGS. 1A and 1B comprise an exploded, side-elevational, cross-sectional view of one embodiment of the mud saver valve of the present invention illustrating the assembly thereof.
Figure 1B:
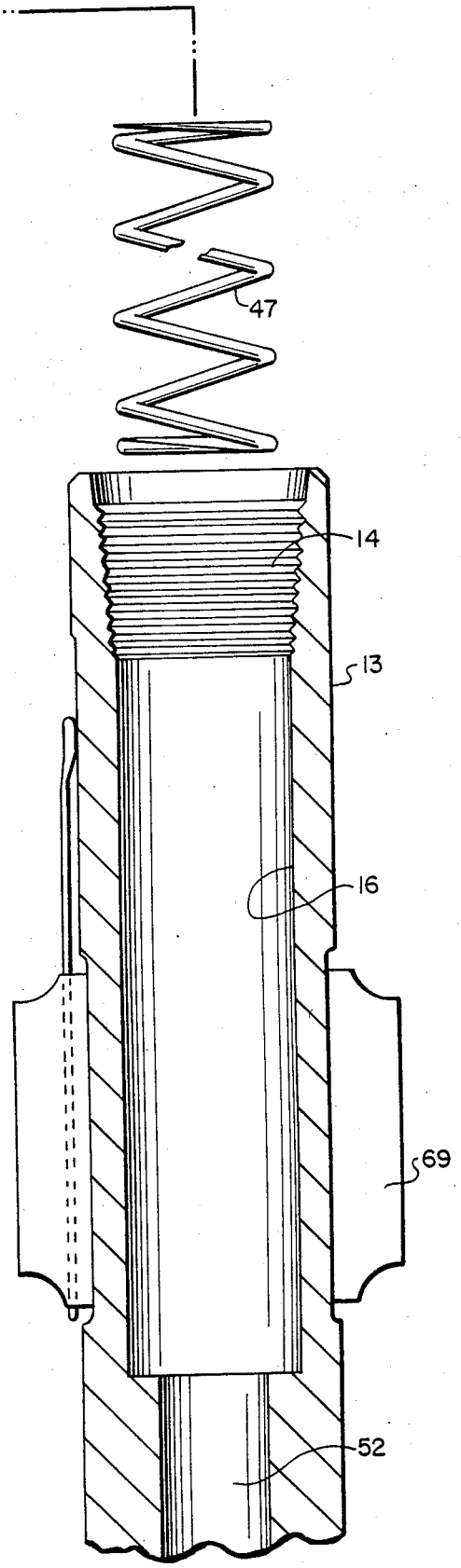

Referring first to FIGS. 1A and 1B there is shown an exploded side-elevational, cross-sectional view of one embodiment of the mud saver valve assembly of the present invention. Mud saver valve assembly 10 comprises a top sub 11 and a lower body portion 13 both formed of a generally tubular configuration. The top sub 11 and body 13 are constructed for coupling in a conventional manner wherein body 13 includes a box 14 and wherein top sub 11 includes a pin 15 for threadable engagement with said box. The upper end of the top sub 11 includes a box (not shown) which is connectable to a kelly (not shown) and a pin (not shown). Lower body 13 is machined to form an annular piston recess 16 for receipt of the piston 30 therein. Piston 30 is adapted for engaging a valve seat 20 constructed for mounting within the to sub 11 and described in more detail below. In this manner, the mud saver valve 10 of the present invention affords the reliability, longevity, and repairability necessary for efficiency in drilling operations.

The assembly of the piston 30 of the present invention incorporates the utilization of a conventional spear member 35 urged upwardly by biasing spring 47 as is conventional in the prior art and set forth and shown in U.S. Pat. No. 4,364,407 assigned to the inventor of the present invention. The present invention, however, provides many distinct advantages over the design set forth in the aforesaid patent in that the top sub 11 may be disassembled from the lower body portion 13 for exposing the piston 30 and the upper valve seat 20 therein. Upper valve seat 20 is constructed of a generally cylindrical configuration adapted to be received in upper valve seat recess 17 formed in top sub 11. Valve seat 20 includes a cylindrical central opening 21 with a lower lip area 22 comprising a seating surface adapted for matingly engaging a male seat element upon said piston 30 as described in more detail below. An O-ring 23 is provided around said upper valve seat 20 to form a seal between the exterior of said valve seat and said seat ring recess 17. The upper valve seat 20 is secured within the top sub 11 by a spanner ring 24 having adapted for threadably engaging a threaded recess 25 formed beneath the valve seat recess 17 and top sub 11. In this manner, the valve seat 20 may be easily assembled and disassembled for maintenance. It may further be seen that the valve seat 20 is of integral construction and does not include an elastomeric seat as set forth in certain prior art constructions. Instead, the upper valve seat 20 comprises a seating surface 22 formed of a curved outwardly tapering configuration comprising a generally infundibular orifice in combination with said central aperture 21 that is adapted for matingly engaging a lower diverter valve seat 26. The lower diverter valve seat 26, described in more detail below, incorporates a curved head region 27 with a downwardly tapering configuration defined herein as a generally exfundibular head region adapted for matingly engaging the seating surface 22 of the upper valve seat 20. In this manner all valve closure elements are constructed of a suitably strong material for withstanding the abrasive conditions of mud flow therethrough. Moreover, the elimination of elastomeric materials in the mud flow path adds to the longevity of use between maintenance repairs. Obviously the abrasive mud flow is less deleterious on hard surfaces such as steel or the like of which the valve seating surfaces 22 and 27 may be formed. In accordance with one aspect of the present invention, said seating surfaces may also be formed of ceramics or other suitable hard material that are capable of withstanding the deleterious effect of high pressure mud flow.

One distinct advantage of the mating infundibular-/exfundibular valve seat configuration 22–27, is the effective fluid flow sealing therebetween and the provision for reduction in flow turbulence during opening of said valve. The aforesaid prior art U.S. Pat. No. 4,364,407 addressed the fluid flow problem around the flat, abutting seating ring surfaces by providing a downwardly depending annular skirt. Due to the sealing configuration of the valve seats it was found that most of the washing of the interior of the body occurred immediately below the seat ring. This was due mainly to the abutting relationship between the respective valve seats and the indirect non-uniform fluid flow therefrom. The lateral spray of the drilling fluid created great turbulence in the region necessitating a tapered skirt as provided therein. Provision was even made for replacing the skirt along with the sealing ring due to the inherent degeneration of the design thereof. The present invention facilitates directional fluid flow in conjunction with the infundibular tapered orifice between valve seats 22 and 27 and the streamlined inner piston body therebelow as defined hereinafter.

Figure 2:
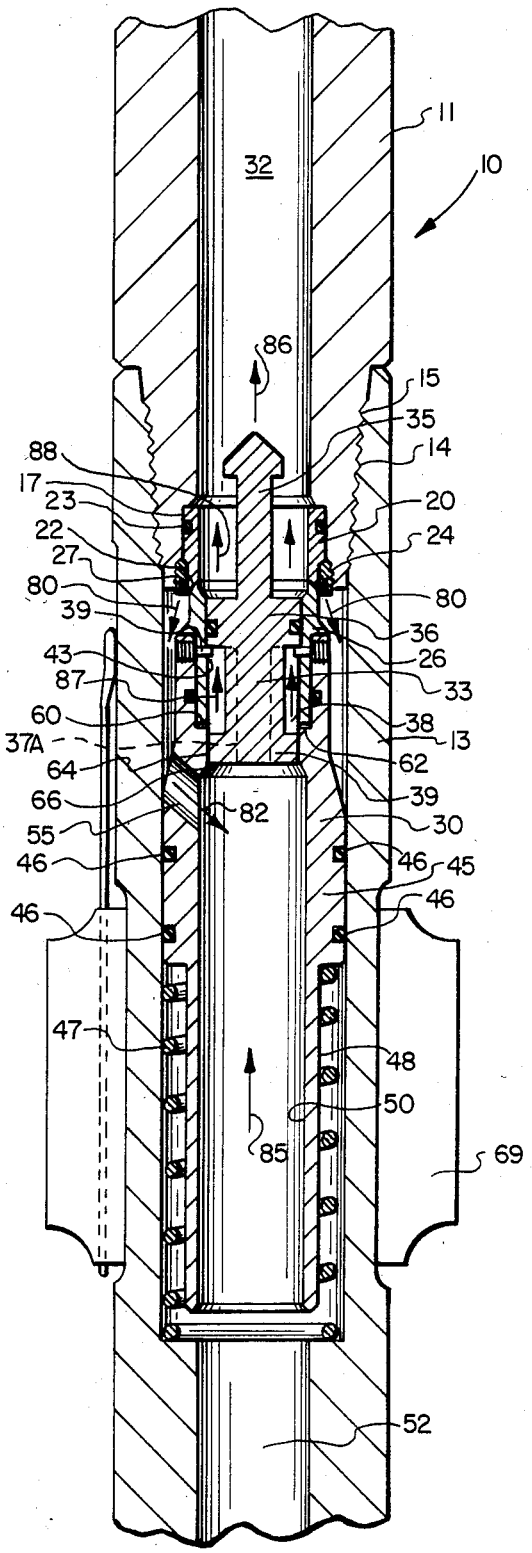
FIG. 2 is a side-elevational, cross-sectional view of the mud saver valve of FIG. 1 shown in an assembled configuration with all valve members in a closed configuration.

Referring now to FIGS. 1A and 2, the piston 30 is axially movably disposed in body 13 below the upper seating ring 20. Piston 30 incorporates lower, exfundibular seating element 26 having top seating surface 27 adapted for mating engagement with upper seating surface 22. Piston 30 also includes the bore 32 coaxial with central opening 21 of the upper valve seat 20. Bore 32 is normally occluded interior of valve seat 22 by a plug 33, from which upstands a spear 35 axially movably disposed within the lower valve seat 26.

Plug 33 includes an intermediate body portion 37 having a cylindrical upper portion 36 which normally forms a plug within lower valve seat 26. The body portion 37 also includes a lower cylindrical body region 39 with an intermediate slotted region 38 formed therebetween with slotted flow areas 37A therein. It is the slotted areas 37A which permit upward fluid flow as described below. A plurality of flow passages 38 are thus formed for permitting select upwardly flow therethrough. During back flow conditions, spear 35 is driven axially upwardly with respect to lower valve seat 26, such that mud flows through the flow passages 38 and inside upper valve seat 20. The area of the flow passages 38 is substantial and allows significant back flow of mud when the downhole pressure exceeds the head of the kelly. The upward travel of spear 35 during backflow is limited by a plurality of sheer pins 39 which extend radially inwardly to engage the bottom region 39 of plug 33 as shown in more detail below.

The plug 33 is normally retained within the bore 32 by the sheer pins 39. If it is desired to remove plug 33 from bore 32, an overshot may be used to grasp spear 35 and apply an upward force to sheer pins 39 and thereby remove the plug 33 therefrom. Such removal allows full access to bore 32 so that fishing tools may be run down the drill string. An upward force may be applied to spear 35 to sheer pins 39 in a conventional manner. It may be seen that this provision is also provided in U.S. Pat. No. 4,364,407 referred to above although the assembly elements in configuration are substantially different.

Still referring to FIGS. 1A, 1B and 2, piston 30 includes an intermediate flange region 45 which extends radially outwardly into sliding engagement with recess 16 of the body 13. In order to form a seal between the body 13 and flange 45, O-rings 46 may be provided. It may be seen that the intermediate flange region 45 of the present invention is constructed in an elongate configuration to provide axial and lateral stability to the piston 30 within the lower body 13. For this reason, two O-rings 46—46 are provided and disposed in parallel spaced relationship one from the other along flange 45 to maintain axial and lateral stability. Axial and lateral stability are critical elements for valve seat alignment in accordance with the principles of the present invention and plug 33 is likewise constructed with an upper and lower cylindrical body regions 36 and 39, respectively, which allow precise axial alignment of said spear unit 35 within bores 32. As set forth herein said axial alignment facilitates reliability in all operational modes. Piston 30 is next seen to be urged upwardly against valve seat 22 by a spring 47. The spring 47 is positioned and compressed between flange 45 and a lower portion of the bore of body 13. Piston 30 is also centralized within body 13 by the elongate flange region 45. Stabilizing fins and the like previously provided by prior art embodiments are thus not necessary. This design aspect reduces the cost, weight and complexity of the unit and further facilitates reliability in operation.

Figure 3:
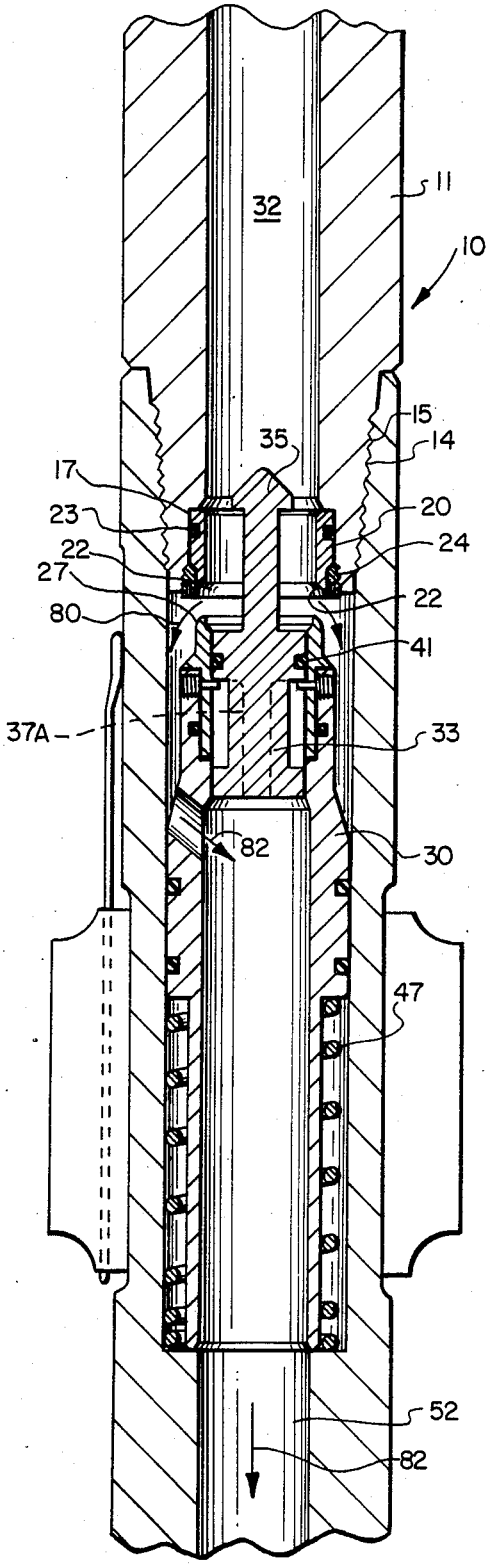
FIG. 3 is a side-elevational, cross-sectional view of the assembly of FIG. 2 with the piston depressed in the downwardly mud flow configuration showing one mode of operation of the mud valve in the present invention.

In order to allow drilling mud to flow into bore 32, a plurality of ports 55 are provided. Unlike many prior art embodiments, the ports 55 of the present invention are angularly formed in the piston body 30 across the upper region of the flange 45. In this region of the flange 45, a tapered configuration is provided as shown in FIG. 1A. The taper of flange 45 facilitates the flow of fluid into ports 55 as the fluid flows from the upper valve seat 22. The pressure of the mud during the drilling first moves lower seating surface 27 away from upper valve seat 22. The pressure then acts on flange 45 to drive piston 30 fully downwardly within the body 13 as shown in FIG. 3, thus allowing the mud to flow smoothly and with the minimum of turbulence through the valve assembly 10. It may also be seen that a flange member 53 is formed outwardly of the lower valve seat 26 to abut against upper surface 55 disposed above flange 45.

The outwardly tapering flange 53 further facilitates smoother fluid flow downwardly from the valve seat 22, directing said fluid flow outwardly and along the body of the piston 30 downwardly to the ports 55 for entry into lower bore region 50. In order to preserve the sealed engagement between the respective elements, lower valve seat 26 is concentrically positioned within the piston body 30 with an O-ring 59 sealed therearound beneath the flange 53. The interior bore 43 of the lower seating element 26 terminates in end portion 60 which rests above the shoulder region 62 formed in central bore 32. A necked bore region 64 is provided below a shoulder region 62 and tapered bore region 66 is provided immediately therebeneath. Taper 66 terminates adjacent the angular outward mud flow ports 55 to comprise a generally infundibular flow orifice through bore 32 in provision for the aforesaid back pressure mud flow conditions. These particular assembly features further facilitate the operation, maintenance, and repairability of the unit as described in more detail below.

Referring particularly now to FIG. 2 there is shown a side elevational, cross-sectional view of the mud valve element set forth in FIGS. 1A and 1B in an assembled configuration. The assembly and interaction of the various valve elements have heretofore been discussed. However, the valve assembly 10 is designed for three distinct positional modes, to wit: "closed", "open down" and "open up". The plug 33 in this particular illustration is in the occluded position with the valve seats 22 and 27 in flush engagement thereacross. In this "closed" mode, the valve assembly 10 is in position for preventing any drilling mud flow therethrough. It may be seen that the spring 47 has thus urged the piston 30 upwardly to force engagement between the lower valve seat 26 and upper valve seat 20. Pressure from fluid in upper bore 32 in top sub 11 maintains the plug 33 and spear 86 in the downward position with the necessary sealing configuration preventing mud flow therethrough.

Referring now to FIG. 3 there is shown the mud valve assembly 10 in a first operational configuration with the piston 30 in the "open down" or depressed position with mud flowing downwardly through bore 32 around spear 35 and between valve seats 22 and 27. The mud flow as indicated by arrow 80 flows downwardly around the annular cavity between body 13 and piston 30 through ports 55 and into the lower bore 52. In this position the plug 33 remains in the closed mode relative to the piston 30.

Figure 4:
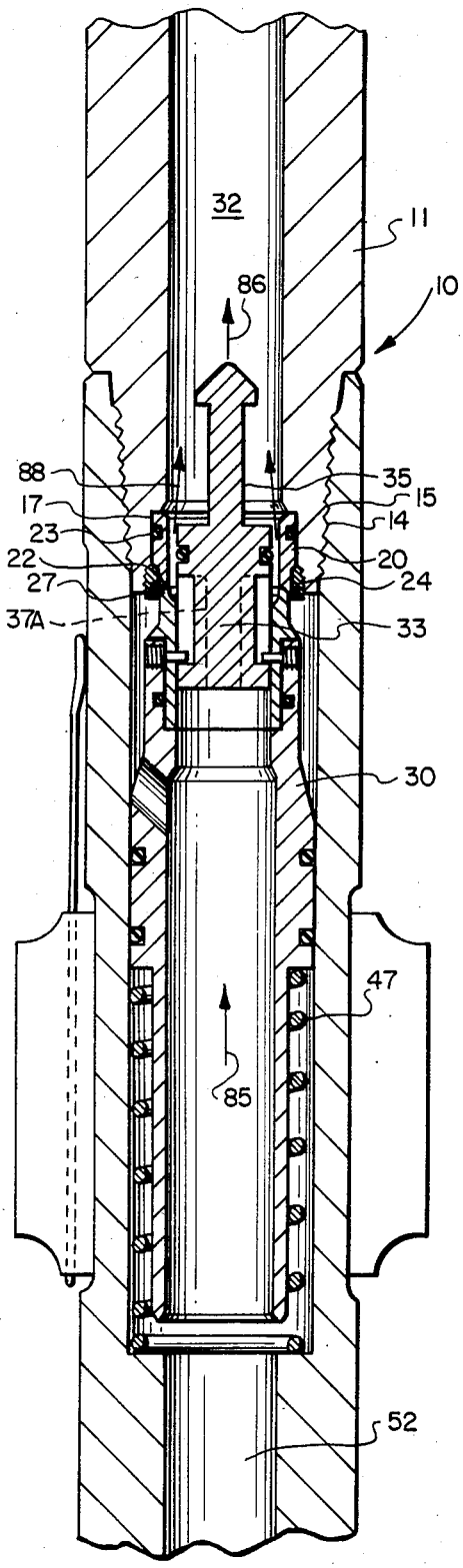
FIG. 4 is a side-elevational, cross-sectional view of the assembly 10 of FIG. 2 with the plug disposed in an upward open position to permit mud flow upwardly through the mud valve to illustrate a second mode of operation thereof.

Referring now to FIG. 4 there is shown the assembly 10 of the present invention in the back flow or "open up" condition. In this position, the piston 47 maintains the piston in the upwardly seated position with valve seats 22 and 27 matingly engaging one another to prevent flow therethrough. Downhole pressure forcing mud through lower bor 52 and upwardly through piston 30 has forced the plug 33 upwardly with spear 35 moving in the direction of arrow 86. The lower body region 39 of the plug 33 is shown to have moved upwardly within the lower valve seat 26 in abutting engagement and retained by pins 39. The flow channels 37A are thus open to flow communication between lower bore 52 and upper bore 21 within upper valve seat 20. This permits the mud flow in the direction of arrow 88 upwardly through the top sub 11 to relieve the downhole pressure. The relative position of the various elements above described may thus be viewed in all operational positions.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved mud saver valve of the type comprising a tubular body connectable between a kelly and a drill string and a piston axially movable within said tubular body forming a valve seat therein and incorporating a plug removably mounted therein to normally close said bore with said piston being biased into engagement with said valve seat for the closure thereof, the improvement comprising:

said tubular body being formed of upper and lower tubular sections;

an upper valve seat formed in a lower region of said upper tubular body section and constructed with a generally cylindrical, curved valve seating recess therearound;

said piston being constructed with a lower valve seat member in an upper end thereof adapted for matingly engaging said upper valve seat member and formed with a generally cylindrical, curved edge portion adapted for matingly engaging said curved recess of said upper valve seat;

said piston being formed with a generally cylindrical, elongate intermediate body portion comprising a flange region adapted for receipt in, axial alignment with, and slidable engagement through said lower tubular member for facilitating the axial alignment and lateral stability of said upper and lower valve seats; and means for coupling said upper and lower tubular sections one to the other for the engagement of said upper and lower valve seats disposed thereon.

2. The apparatus as set forth in claim 1 wherein said piston further comprises a hollow bore centrally formed therethrough and wherein said lower valve seat comprises a valve seat sleeve adapted for receipt within said bore and securement atop said piston, said valve seat sleeve being formed with an outer curved edge portion adapted for matingly engaging said upper valve seat recess.

3. The apparatus as set forth in claim 2 wherein said piston valve sleeve comprises a generally cylindrical member adapted for receiving said plug therein and the axial reciprocation of said plug relative thereto, said piston valve sleeve being further formed with a generally centrally disposed flange member extending outwardly therearound in a downwardly tapering configuration for abuttingly engaging an upper end of said piston and forming a smooth flow surface thereover for mud flowing between said valve seats.

4. The apparatus as set forth in claim 3 wherein said piston is further constructed with a plurality of ports formed adjacent said flange in angled relationship relative thereto for facilitating the smooth flow of mud therein and through said bore of said piston.

5. The apparatus as set forth in claim 1 wherein said plug is disposed in said piston and comprises a generally cylindrical body portion having a centrally aligned spear upstanding therefrom, said body portion being formed with upper and lower generally cylindrical body regions disposed on opposite ends of a central, necked, slotted, body portion adapted for the flow of mud upwardlY therethrough when said plug is shifted upwardly relative to said piston.

6. A well bore mud saver valve of the type positionable between a kelly and a drill string disposed within a borehole adapted for the flow of drilling mud therethrough, said valve comprising:

a housing adapted for securement between said kelly and drill string and being formed with an axial bore therethrough;

an upper valve seat formed within said housing bore and constructed with a generally cylindrical, curved valve seating recess therearound;

a piston disposed within said housing bore beneath said upper valve seat and being formed with a lower valve seat in an upper end thereof adapted for matingly engaging said upper valve seat and formed with a generally cylindrical, curved edge portion adapted for matingly engaging said curved recess of said upper valve seat;

said piston being axially movable within said housing and being upwardly biased into engagement with said upper valve seat for the closure thereof; and said piston being formed of a generally cylindrical, elongate intermediate body portion comprising a flange region adapted for receipt in, axial alignment with, and slidable engagement through said bore of said housing for facilitating the axial alignment and lateral stability of said upper and lower valve seats.

7. The apparatus as set forth in claim 6 wherein said piston further includes a plug removably mounted therein to normally close said bore with said piston in said upwardly biased position of engagement with said upper valve seat.

8. The apparatus as set forth in claim 6 wherein said piston further comprises a hollow bore centrally formed therethrough and wherein said lower valve seat comprises a valve seat sleeve adapted for receipt within said bore and securement atop said piston, said valve seat sleeve being formed with an outer curved edge portion adapted for matingly engaging said upper valve seat recess.

9. The apparatus as set forth in claim 8 wherein said valve sleeve further comprises a generally centrally disposed flange member extending outwardly therearound in a downwardly tapering configuration adapted for abuttingly engaging an upper end of said piston and forming a smooth flow surface thereover for mud flowing downwardly between said valve seats.

10. The apparatus as set forth in claim 9 wherein said piston valve sleeve comprises a generally cylindrical member adapted for receiving said plug therein and the axial reciprocation of said plug relative thereto.

11. The apparatus as set forth in claim 10 wherein said piston is further constructed with a plurality of ports formed adjacent said flange in an angled relationship relative thereto for facilitating the smooth flow of mud therein and through said bore of said piston.

12. The apparatus as set forth in claim 6 wherein said means biasing said piston upwardly against said upper valve seat comprises a spring axially disposed within said bore disposed around a lower region of said piston and in abutting engagement with said piston for urging said piston upwardly relative to said upper valve seat.

13. The apparatus as set forth in claim 6 wherein said housing is constructed in a generally cylindrical configuration comprising a tubular body formed with a hollow bore therethrough.

14. The apparatus as set forth in claim 13 wherein said tubular housing is comprised of upper and lower body sections, said upper and lower body sections being adapted for threadable engagement one with the other.

15. The apparatus as set forth in claim 14 wherein said upper valve seat is disposed in the lower end of said upper tubular body portion and comprises a generally cylindrical member secured therein.

16. The apparatus as set forth in claim 15 above wherein said generally cylindrical upper valve seat member disposed within said lower end of said upper tubular member is constructed with an inner lip having a generally infundibular orifice therethrough and an outer lip adapted for engagement with securing means for securing said cylindrical member within said upper tubular housing member.

17. The apparatus as set forth in claim 16 said piston is comprised of a generally hollow tubular member formed with an upper and lower necked regions and an intermediate body portion adapted for slidable engagement within said bore of said lower tubular housing member.

18. The apparatus as set forth in claim 17 above wherein said intermediate body portion is of enlarged diameter and comprises upper and lower circumferential grooves formed therearound adapted for receiving O-rings therein for slidable engagement within said bore of said lower tubular housing member and the sealing of fluids therealong, and facilitating the axial and lateral stability of said piston relative to said bore of said lower tubular housing member.

19. The apparatus as set forth in claim 18 wherein said lower tubular housing member comprises an axial bore formed therethrough having an upper bore region of enlarged diameter adapted for receiving said piston in slidable engagement therewith and a lower bore section concentrically disposed relative thereto and forming a lateral shoulder member therearound adapted for receiving said biasing means thereupon for upwardly urging said piston against said upper valve seat.

20. A method of mud saving in a well bore by the utilization of a valve positionable within a drill string disposed within a borehole between a kelly and a drill bit adapted for the flow of drilling mud therethrough, said method comprising the steps of:

providing a housing having an axial bore formed therethrough;

securing said housing between said kelly and said drill string;

forming an upper valve seat within said housing bore with a curved, infundibular valve seating recess therearound;

providing a piston formed with a lower valve seat in an upper end thereof member adapted for matingly engaging said upper valve seat and formed with a generally cylindrical exfundibular edge portion adapted for matingly engaging said curved, infundibular recess of said upper valve seat;

forming said piston with a generally cylindrical, elongate intermediate body portion comprising a flange region adapted for receipt in, axial alignment with, and slidable engagement through said bore of said housing for facilitating the axial alignment and lateral stability of said upper and lower valve seats;

disposing said piston within said housing bore beneath said upper valve seat;

mounting said piston for axial movement within said housing; and biasing said piston into engagement with said upper valve seat for the closure of said valve.

21. The method as set forth in claim 20 wherein said step of providing said piston further includes the step of removably mounting a plug therein to normally close said bore with said piston in said bias position of engagement with said upper valve seat.

22. The method as set forth in claim 20 wherein said step of providing said piston further comprises the steps of forming a hollow bore centrally therethrough, providing a valve seat sleeve adapted for receipt therein said valve seat sleeve being formed with an outer curved edge portion adapted for matingly engaging said upper valve seat recess, and securing said valve seat atop said piston.

* * * * *